United States Patent [19]

Pierce et al.

[11] Patent Number: 5,041,386

[45] **Date of Patent: * Aug. 20, 1991**

[54] CONCENTRATION CYCLES, PERCENT LIFE HOLDING TIME AND CONTINUOUS TREATMENT CONCENTRATION MONITORING IN BOILER SYSTEMS BY INERT TRACERS

[75] Inventors: Claudia C. Pierce, Lisle; Roger W. Fowee, Wheaton; John E. Hoots, St. Charles, all of Ill.

[73] Assignee: Nalco Chemical Company, Naperville, Ill.

[ * ] Notice: The portion of the term of this patent subsequent to Nov. 8, 2005 has been disclaimed.

[21] Appl. No.: 286,034

[22] Filed: Dec. 19, 1988

[51] Int. Cl.[5] ..... G01N 35/08

[52] U.S. Cl. ..... 436/50; 436/38; 436/52; 436/56; 436/150

[58] Field of Search ..... 436/50, 38, 52, 56, 436/150

[56] References Cited

U.S. PATENT DOCUMENTS

| | | | |
|---|---|---|---|
| 4,251,220 | 2/1981 | Larson et al. | 23/230 R |
| 4,264,329 | 4/1981 | Beckett | 23/230 EP |
| 4,472,354 | 9/1984 | Passell et al. | 422/62 |
| 4,822,744 | 4/1989 | Bellows | 436/38 |

*Primary Examiner*—Richard L. Raymond
*Assistant Examiner*—Brian M. Burn
*Attorney, Agent, or Firm*—Kinzer, Plyer, Dorn, McEachran & Jambor

[57] ABSTRACT

Concentration cycles, percent life holding time for a component in the boiler and continuous treatment concentrations are monitored or determined in a boiler system by adding to the feedwater an inert tracer in a predetermined concentration $C_I$, which reaches a final concentration $C_F$ at steady state in the boiler and which exhibits a blowdown concentration $C_t$ at different points in time. The component is an inert tracer having no significant carryover in the steam, nor significant degradation during boiler cycles. The tracer is monitored by continuously converting a characteristic of its concentration to an analog which may be recorded as a function of time.

11 Claims, 4 Drawing Sheets

Fig. 1.
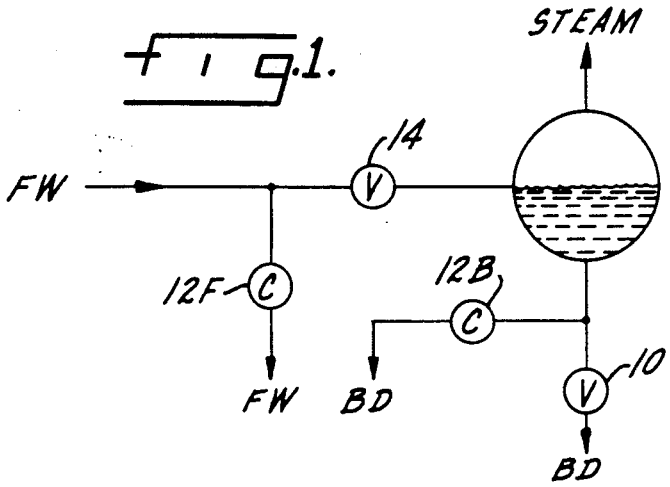
Fig. 2.
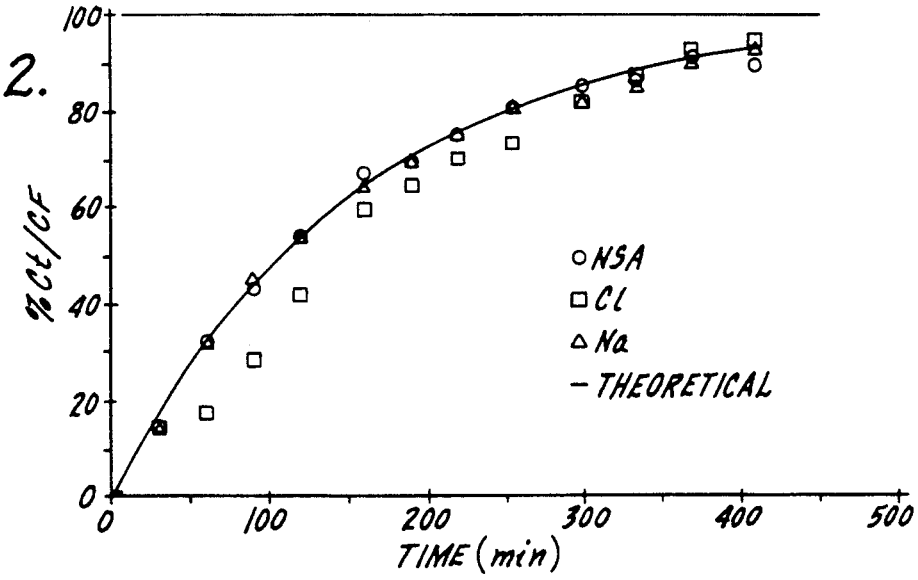
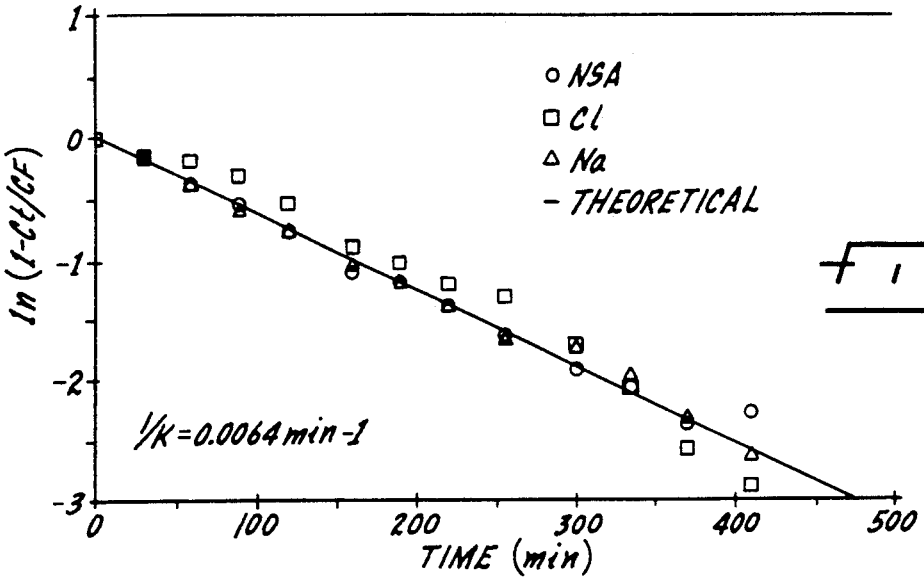
Fig. 3.

CONCENTRATION CYCLES, PERCENT LIFE HOLDING TIME AND CONTINUOUS TREATMENT CONCENTRATION MONITORING IN BOILER SYSTEMS BY INERT TRACERS

INTRODUCTION

This invention relates to boiler water systems and in particular to a method and means for determining cycles, percent life holding time and monitoring treating agents added to the boiler feedwater.

Deposits, particularly scale, can form on boiler tubes. Each contaminant constituting the source of scale has an established solubility in water and will precipitate when it has been exceeded. If the water is in contact with a hot surface and the solubility of the contaminant is lower at higher temperatures, the precipitate will form on the surface, causing scale. The most common components of boiler deposits are calcium phosphate, calcium carbonate (in low-pressure boilers), magnesium hydroxide, magnesium silicate, various forms of iron oxide, silica adsorbed on the previously mentioned precipitates, and alumina.

At the high temperatures found in a boiler, deposits are a serious problem causing poor heat transfer and a potential for boiler tube failure. In low-pressure boilers with low heat transfer rates, deposits may build up to a point where they completely occlude the boiler tube.

In modern intermediate and higher pressure boilers with heat transfer rates in excess of 200,000 Btu/ft$^2$hr (5000 cal/m$^2$hr), the presence of even extremely thin deposits will cause a serious elevation in the temperature of tube metal. The deposit retards flow of heat from the furnace gases into the boiler water. This heat resistance results in a rapid rise in metal temperature to the point at which failure can occur.

Deposits may be scale, precipitated in situ on a heated surface, or previously precipitated chemicals, often in the form of sludge. These collect in low-velocity areas, compacting to form a dense agglomerate similar to scale. In the operation of most industrial boilers, it is seldom possible to avoid formation of some type of precipitate at some time. There are almost always some particulates in the circulating boiler water which can deposit in low-velocity sections.

Boiler feedwater, charged to the boiler, regardless of the type of treatment used to process this source of makeup, still contains measurable concentrations of impurities. In some plants, contaminated condensate contributes to feedwater impurities.

When steam is generated from the boiler water, water vapor is discharged from the boiler, with the possibility that impurities introduced in the feed water will remain in the boiler circuits. The net result of impurities being continuously added and pure water vapor being withdrawn is a steady increase in the level of dissolved solids in the boiler water. There is a limit to the concentration of each component of the boiler water. To prevent exceeding these concentration limits, boiler water is withdrawn as blowdown and discharged to waste. FIG. 1 illustrates a material balance for a boiler, showing that the blowdown must be adjusted so that impurities leaving the boiler equal those entering and the concentration maintained at predetermined limits.

Substantial heat energy in the blowdown represents a major factor detracting from the thermal efficiency of the boiler, so minimizing blowdown is a goal in every steam plant.

One way of looking at boiler blowdown is to consider it a process of diluting boiler water impurities by withdrawing boiler water from the system at a rate that induces a flow of feed water into the boiler in excess of steam demand.

Blowdown used for adjusting the concentration of dissolved solids (impurities) in the boiler water may be either intermittent or continuous. If intermittent, the boiler is allowed to concentrate to a level acceptable for the particular boiler design and pressure. When this concentration level is reached, the blowdown valve is opened for a short period of time to reduce the concentration of impurities, and the boiler is then allowed to reconcentrate until the control limits are again reached. In continuous blowdown, on the other hand, which is characteristic of all high pressure boiler systems, virtually the norm in the industry, the blowdown valve is kept open at a fixed setting to remove water at a steady rate, maintaining a relatively constant boiler water concentration.

SUMMARY AND OBJECTIVES OF THE INVENTION

Under the present invention, boiler cycles may be readily calculated by adding an inert tracer to the feedwater being charged to the boiler in a known concentration and then determining an analog of its concentration in the blowdown. Resultantly, if the cycles value does not compare to standard, then the blowdown rate is altered or the dosage of treating agent is changed, or both. The change in concentration of the tracer during the time required for it to attain its final, steady state concentration in the boiler water may also be determined by monitoring the concentration of the tracer in the blowdown, as a function of time. Once the final steady state concentration of the tracer is known, the percent life holding time of the boiler can be calculated, enabling a judicious choice of a particular treating agent to be made. The concentration of the treating agent in the feedwater and elsewhere may itself be monitored by proportioning the treating agent and tracer.

The primary objects of the present invention are to employ an inert tracer, preferably a fluorescent tracer, to simplify the determination of cycles [impurity (contaminant) concentrations] in boiler waters, especially on a continuous basis; to employ an inert tracer to calculate the percent life holding time (e.g. half-life time); and to employ an inert tracer as a reference standard monitor to determine the concentration of a treating agent (e.g. dispersant polymer) used to resist (oppose) the tendency of impurities to settle on the boiler surfaces. The inert tracer may be used for all or any single determination.

BRIEF DESCRIPTION OF THE DRAWING

FIG. 1 is a diagram showing how boiler water solids (scales) are controlled by blowdown;

FIG. 2 is a curve showing the variation of a concentration ratio as a function of time;

FIG. 3 is a logarithmic plot based on FIG. 2 also showing how the concentration ratio varies with time;

DETAILED DESCRIPTION

A: Boiler Cycles

Figure 4:
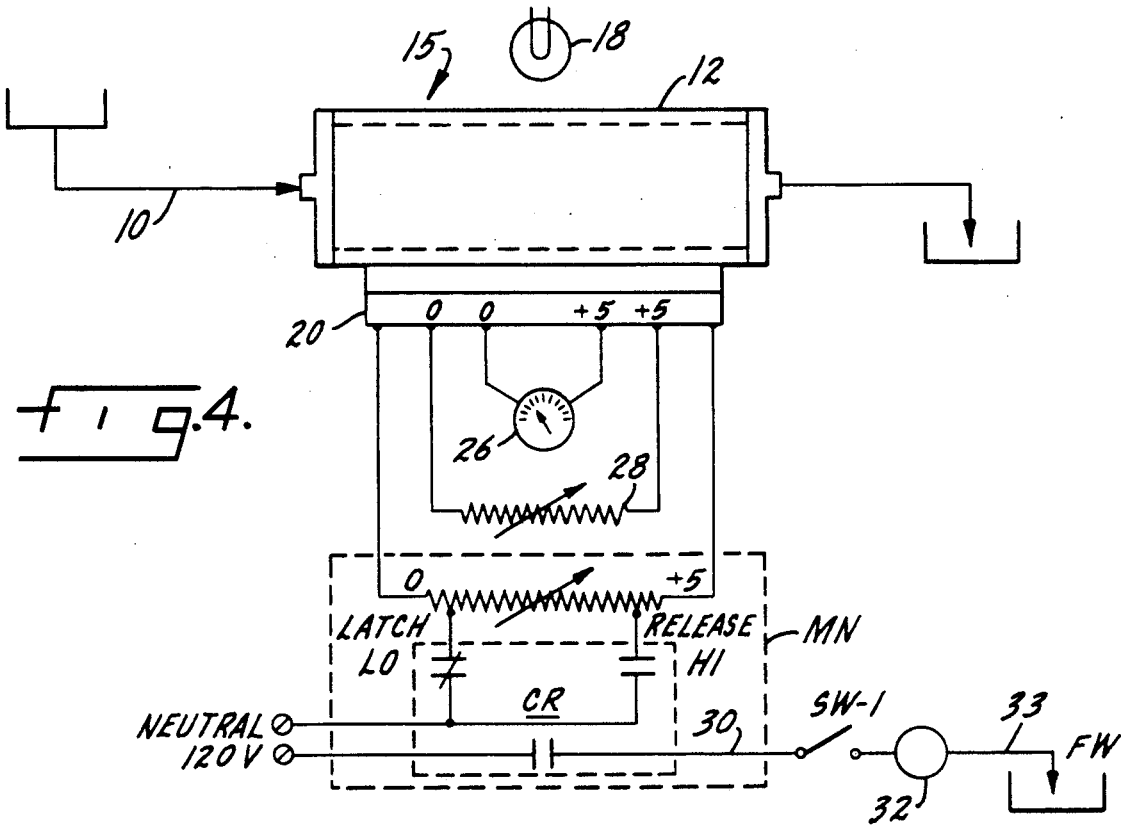
FIG. 4 is a schematic view of instrumentation.

Boiler cycles is defined herein as the concentration ratio of a particular impurity (or component) in the blowdown $C_F$ and the feedwater $C_I$, that is, $$\text{cycles} = C_F/C_I = \frac{\text{steady state blowdown concentration}}{\text{feedwater concentration}}$$

and the value (which is an equilibrium value) will always be greater than one since the impurity in the blowdown is always more concentrated than in the feedwater due to water removed as steam.

For high pressure boiler systems determination of cycles by this method is very difficult since feedwater purity is very high and therefore concentration of feedwater contaminants is very low. Monitoring cycles in boiler systems is quite important since suspended solids can concentrate in the boiler water up to the point which exceeds their solubility limit as discussed in more detail above.

If the cycles value is too low, there is wastage of water, heat and any treating agent which may be present. If the value is too high, there is likelihood of dissolved solids settling out.

Inert tracers, such as fluorescent tracers, offer a particular advantage for cycles determination since they do not appreciably carry over into the steam and can be selectively detected at very low levels (0.005 ppm or less). The tracer will have a characteristic which can be sensed and converted to a concentration equivalent. For example, fluorescent emissivity, measured by a fluorometer, is proportional to concentration; emissivity can be converted to an electrical analog. Their concentration in the boiler water does not contribute significantly to conductivity, which is of advantage.

B: Percent Life Holding Time (% HT)

Any time there is a change in addition of a treating agent added to the feedwater, it takes time for the boiler to reach steady state where the concentration of the component is at equilibrium. This time lapse is the holding time for the boiler. If percent life holding time is known, it may be used for judicious or efficient treating agent dosage. It may indicate a need to adopt a different cycles value. In any event, the life holding time, that is, the percent time for a component to reach its final concentration in the boiler, is a diagnostic tool for the boiler; each boiler is as unique as a fingerprint and the present invention permits the boiler to be fingerprinted easily and quickly.

Knowledge of the cycles value does not take into account all the specifics of the boiler. Different boilers, though of similar construction, can operate at the same number of cycles but, depending on the operating boiler volume and blowdown rate, they can have quite different percent life holding times. Steady state is defined herein as the circumstance where a stable or inert component (e.g. the inert tracer) in the feedwater reaches its final concentration ($C_F$) in the boiler without any appreciable or significant changes in the system except generation of steam. The concentration of the component inside the boiler and in the blowdown will be the same ($C_t$) at any particular point in time so that a measurement of one measures the other. The rate at which a stable component will reach steady state in the boiler water is determined by the boiler characteristics M (mass of boiler water, in lbs) and B (blowdown rate, in The time required to reach steady state can be an important factor for application of the treating agent. In terms of its differential equation, this time value is expressed as $$t = -K\ln(1 - C_t/C_F) \quad (1)$$

where $C_F$ = final steady-state boiler water concentration of the component

K = boiler constant = M/B $C_t$ = concentration of component in the blowdown at any time t.

Equation 1 can be rearranged:

$$\ln(1 - C_t/C_F) = -(1/K)t \quad (2)$$

and a plot of $\ln(1 - C_t/C_F)$ versus time gives the slope of $1/K$.

Using these equations, it is possible to calculate percent life holding time (%HT) of the boiler.

$$\%HT(P) = -K\ln[1 - (P/100)] \quad (3)$$

where (P) symbolizes percent life of component C and $P = C_P/C_F \times 100$ where $C_P$ = concentration of component C at the desired %HT and where $C_F$ = steady state boiler concentration of component C.

Thus, at the half life of the boiler for example [%HT(50)], P = 50 and equation (3) becomes %HT(50) = 0.693K. If K and $C_F$ are known, %HT(P) can be calculated for an assumed value of $C_P$; or if %HT(P) is assumed, then $C_P$ can be calculated in equation (3).

The boiler constant K is rarely known in the field, since very often neither the operating boiler volume nor the blowdown rate is exactly known. It is very important for the application of internal boiler treatments, by a treating agent meant to prevent or inhibit scaling, to know the boiler percent life holding time. One reason is that different treating agents perform differently over prolonged periods at a given temperature, or at different temperatures for the same time, and cost may be a factor. To be on the safe side, the recommendation may be that the treating agent be held in the boiler no more than ninety percent, or even fifty percent, of the holding time of the boiler. In other words, thermal stability or sustained potency of internal boiler treatment at high temperature (e.g. up to 300° C.) is affected by the time required to reach steady state, calculated for example by the boiler percent life holding time especially in high pressure boilers in which the pressure may be 2000 pounds. It is possible that in some high pressure systems the blowdown rate has to be increased in order to decrease the percent life holding time and still maintain acceptable treating agent concentration in the boiler water. In other words, if the percent life holding time is inordinately long so that scarcely any treating agent at reasonable cost can withstand the rigors of time-temperature-pressure inside the boiler, then the blowdown rate should be increased since that will bring in more (cold) feedwater. Besides, the treating agent then has less residence time in the boiler.

Inert tracers such as fluorescent tracers can be used very effectively to measure the boiler constant $K=M/B$ and the percent life holding time by determining how tracer concentration varies as a function of time. Thus, the tracer becomes the "component" in the above equations by which cycles and percent life holding time may be calculated under the present invention.

C: Tracer Monitoring

The concentration of the treating agent is very often difficult to monitor due to complicated, tedious analytical methods or difficulty in proper operator training. The addition of an inert tracer can help solve this problem and allows continuous monitoring to be undertaken. If the treating agent/tracer ratio is known, any variation in tracer concentration will be directly related to the concentration of the treating agent which can therefore be easily controlled by continuous monitoring of the tracer. The use of an inert tracer also makes it possible to identify improper treating agent feed due to mechanical problems (such as feed pumps) and changes in boiler operation due to general malfunctions (such as a plugged blowdown valve).

Naphthalene Sulfonic acid (2-NSA) is an inert fluorescent compound which may be employed under the present invention. The concentration of the fluorescent tracer is preferably measured by excitation at 277 nm and emission observed at 334 nm. The emission results are referenced to a standard solution of 0.5 ppm 2-NSA (as acid actives). A Gilford Fluoro IV dual-monochromator spectrofluorometer was used for fluorometric determinations.

By "inert" we mean the tracer is not appreciably or significantly affected by any other chemistry in the system, or by the other system parameters such as metallurgical composition, heat changes or heat content. There is invariably some background interferences, such as natural fluorescence in the feedwater, and in such circumstances the tracer dosage should be increased to overcome background interference which, under classical analytical chemistry definitions, shall be less than 10%.

FIG. 1 is an aid to the description to follow. It shows a typical material balance for a boiler. Blowdown (BD) needs to be adjusted so that impurities ("solids") leaving the boiler equal those entering; the boiler concentration of impurities is maintained at predetermined limits. The balance may be:

- boiler water containing an equivalent of 1000 mg/l of potential solids;
- feedwater (FW) at one million lb/day; solids equal to 100 mg/l; solids added/day equals 100 lb;
- blowdown: 100000 lb/day; solids content 1000 mg/l; solids removed, 100 lb/day;
- steam at 900,000 lb/day; solids essentially zero.

The cycles value is $1000/100=10$. The boiler solids concentration can be decreased by opening (moreso) the blowdown valve 10; feedback controller 12B also opens (moreso) the feedwater valve 14. The concentration of the tracer component in the feedwater may be monitored and controlled (12F) as will be explained.

A. Determination of Boiler Concentration Cycles

Dependability, reliability and accuracy of the present invention was determined in a laboratory where the M and B values for K could be measured ("mechanical mode") exactly, and where chloride and sodium analyses could be conducted without incurring corrosion of equipment and deposition of solids on the equipment. The inert tracer was 2-NSA.

A determination of boiler concentration cycles was made by measuring 2-NSA concentration in both feedwater ($C_I$) and blowdown ($C_F$). The instrumentation to be described is shown in FIG. 4. The results were compared with cycles determined by other different methods: as mechanical, conductivity, and chloride (or sodium) ions.

EXAMPLE 1

1000 psig-110,000 Btu/ft$^2$hr; 9 ppm acrylic acid/acrylamide copolymer (treating agent, dispersant); 0.05 ppm 2-NSA in feedwater, boiler pH 11.0.

| | Cycles Measurement by: | | | |
|---|---|---|---|---|
| | Tracer | Chloride (Component) | Conductivity (Component) | Mechanical |
| Cycles: | 9.7 | 10.0 | 10.0 | 9.9 |

EXAMPLE 2

1000 psig-110,000 Btu/ft$^2$hr; 9 ppm acrylic acid/acrylamide copolymer; 0.5 ppm 2-NSA in feedwater, boiler pH 11.0

| | Tracer | Chloride (Component) | Conductivity (Component) | Mechanical |
|---|---|---|---|---|
| Cycles: | 9.9 | 9.5 | 9.4 | 10.0 |

EXAMPLE 3

1500 psig-110,000 Btu/ft$^2$ hr; 20 ppm acrylic acid/acrylamide copolymer; 0.05 ppm 2-NSA in feedwater, boiler pH 10.0, boiler $PO_4=10$ ppm.

| | Tracer | Chloride (Component) | Sodium |
|---|---|---|---|
| Cycles: | 10.5 | 10.6 | 10.6 |

EXAMPLE 4

2000 psig-110,000 Btu/ft$^2$ hr; 20 ppm acrylic acid/acrylamide copolymer; 0.05 ppm 2-NSA in feedwater, boiler pH 10.8, boiler $PO_4=10$ ppm.

| | Tracer (Component) | Chloride |
|---|---|---|
| Cycles: | 10.6 | 10.7 |

It should also be mentioned that any cycles value is totally dependent on the mass balance of the system as a whole, known as the mechanical mode of determining cycles. This method is difficult to administer in the field and certainly cannot be done accurately on a continuous basis since mass rates (pounds per hour) are involved, viz.

$$\text{cycles} = \frac{\text{feedwater}}{\text{blowdown}} = \frac{\text{steam + blowdown}}{\text{blowdown}}$$

The cycles value can also be determined, as shown above, by comparing the conductivity of a salt in the feedwater to that passing into the blowdown (conductivity increases) but there are many interferences (random, unknown salts, likelihood of settling or deposition and other anomalies) which can throw off the measurements by as much as 20 or 25 percent if not very carefully performed. This is equally true of trying to evaluate cycles by measuring chloride (corrosive) or sodium ion concentration, as shown above, especially in high pressure systems requiring high purity feedwater which demands exceptionally sensitive classical chemical analytical procedures which are expensive and time consuming.

The cycles value is important because the manufacturer invariably places stringent limitations on the upper limit of impurity concentration in the boiler. But the value determined by the manufacturer is usually an estimate, at best, and one which is not particularly beneficial to the user who may spend a great deal of time verifying the cycles value, or who may employ a consultant to do this. The present invention permits the cycles value to be easily determined continuously on a real-time basis.

Having determined a cycles value by the method of the present invention, it is then a matter of comparing that value to a standard operating value proposed by the boiler manufacturer, or perhaps a standard operating value determined as acceptable by the operator, or perhaps a cycles value finely tuned by the supplier of the treating agent used to encourage removal of the impurities into the blowdown, for example by preventing them from collecting together in the boiler and thus opposing their tendency to settle as solids in the boiler. If the determined value is unacceptable, not comparing favorably to the standard, then the blowdown is to be adjusted accordingly, or the dosage of treating agent altered, or both, depending upon the cycles audit. Thus, if the concentration ratio (cycles) is too high in the boiler the blowdown rate should be increased, or the treating agent dosage increased, or both. An unusually low concentration ratio is significant because that may mean that the dosage of treating agent (expensive) is wastefully high or that the feedwater is being wasted as noted above B. Determination of Percent Life Holding Time A determination of percent life holding time was done by measuring 2-NSA tracer concentration and comparing the results with chloride and sodium ion measurements.

Condition: 1500 psig-110,000 Btu/ft$^2$hr; 20 ppm acrylic acid/acrylamide copolymer; 0.05 ppm 2-NSA in feedwater, boiler pH 10.0, boiler $PO_4$=10 ppm.

FIG. 2 shows the variations in 2-NSA, chloride and sodium concentrations as a function of time.

FIG. 3 shows the same data expressed in logarithmic form. Agreement with experimental and theoretical data were excellent.

From FIG. 3: $1/K=0.0064\ \text{min}^{-1}$, and from equation (3) percent life holding time (50%; half time): Half life$=t_{1/2}=108$ min.

As noted above, knowledge of the time for the boiler to reach a given percent life by equation (3) allows a treating agent to be employed which displays superior performance under those conditions of time and temperature regardless of cost, or alternatively acceptable performance at less cost.

C. Instrumentation; Preferred Embodiment, FIG. 4

The preferred inert tracer is a fluorescent tracer and instrumentation for continuous monitoring of the tracer in the blowdown (and feedwater) is shown schematically in FIG. 4. It contains several major components:

1. a sensor or detector for determining from an on-stream characteristic of the tracer its concentration in the sample, including a transducer which generates an electrical signal (voltage) corresponding to that analysis;

2. an output recording device or other register that generates a continuous record of the concentration analog of the tracer as a function of time; and 3. a feedback controller (monitor) that allows a power outlet, connected to the treating agent feed pump, to be activated and deactivated, depending on the on-stream analysis of the concentration of treating agent represented by the voltage signal from the transducer.

Figure 5:
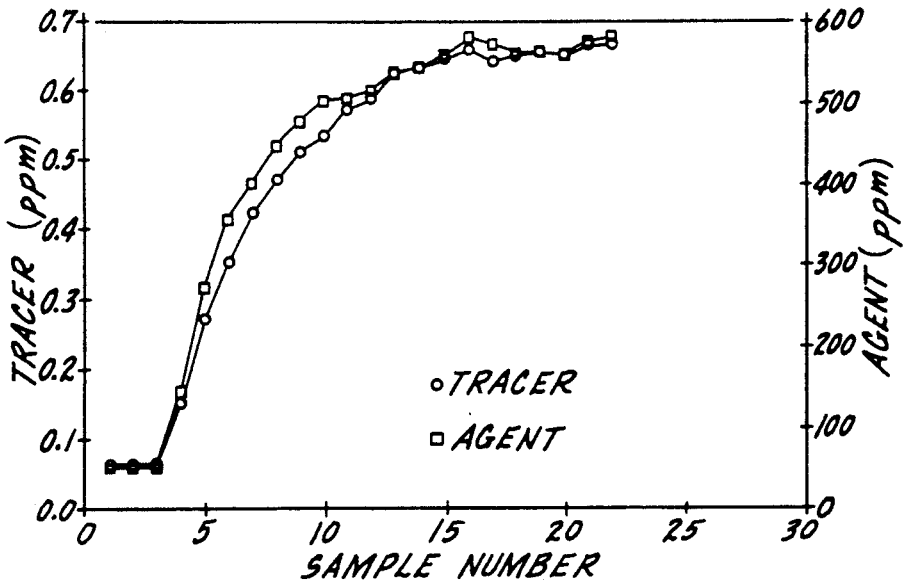
FIG. 5 is a plot showing how closely tracer and treating agent concentration analogs compare at a ratio of 900/1.

At any time instant, the concentration of a component in the blowdown is the same as the concentration of that component in the boiler. After addition of the known concentration $C_I$ of tracer to the feedwater, a sample is taken from a convenient blowdown tap location BD and is passed through a sampling line 10 (conduit) into a flow cell 12 of the analyzer 15 where the concentration $C_t$ of tracer in the sample is analyzed continuously. The concentration of any treating agent present will also be equivalent to the tracer concentration because they are proportioned for this purpose (see FIG. 5). In effect, both the treating agent and tracer concentration are measured on a real-time basis by analysis of the tracer concentration. The blowdown sample undergoing continuous analysis, is returned to the source. Cycles, at steady state, may be monitored or calculated; percent life holding time may be calculated.

The analyzer is preferably a Turner Designs Model Fluorometer 10 (Mountain View, Calif.) having a flow pressure rating of 25 psi. This fluorometer has the advantage of an ample two cm diameter, two inch long flow cell 12, which allows for a large fluorescence intensity, fluorescence being proportional to call path-length. In general, any fluorometer, with a large path-length, and excitation and detection in the ultraviolet (UV) light region can be substituted. Moreover, a fluorometer, while preferred, is only one example of an analyzer for tracers, as will be mentioned in more detail below.

The flow cell 12 is a quartz cylinder having the dimensions noted above. The flow cell is transparent to ultraviolet emitted by a light source 18 directed against one side of the flow cell. At a 90° angle from the light source is a transducer 20 which transforms the emissivity of the fluorescent tracer into a 0–5 volt DC voltage, emissivity (and therefore voltage output) varying with concentration.

A dial indicator 26 is responsive to the output voltage of the transducer (0–5 volts DC) enabling the concentration of tracer to be observed.

A recorder, for a real-time printout of tracer concentration, is identified by reference character 28, responding on an analog (continuous line) basis to the voltage output (0–5 volts, DC) of the transducer element included in the analyzer.

Finally, a monitor MN having HI, LO relay contacts is in communication with the output voltage of the transducer which in effect evaluates the concentration of treating agent (tracer) as noted above. If the evaluation does not compare favorably to the standard, or if it is decided that the treating agent dosage should be controlled constantly by constantly comparing the tracer concentration to a standard, a switch SW-1 is closed manually so that the monitor may transmit a control signal via control line 30 by which a pump 32 is controlled. The standard, of course, will be deemed the concentration of treating agent needed to remove or neutralize the impurity in the feedwater.

The pump 32 may be a variable rate or variable displacement pump, feeding a proportioned amount of the tracer and treating agent through a conduit 33 to the feedwater source FW.

It is not necessary to control the treating agent to a precise value. If, for example, the dosage is 20 ppm, a sensible, practical range is used as the controlling standard, say 18/22 ppm. The relay setpoints (HI, LO) in the monitor will be chosen to energize the pump (close contacts CR) in the event the tracer readout indicates an amount of treating agent deemed too low (18 ppm) and to disable the pump (open contacts CR) when an upper limit of treating agent is attained (22 ppm). The setpoints in the monitor corresponding to these relays may be, for example, 2 volts and 2.5 volts, respectively. One coil (not shown) serves all the contacts shown in FIG. 4; when energized at the LO setpoint, all contacts reverse (closing CR) and when energized at the HI setpoint all contacts reverse (opening CR).

As noted above, the continuous monitor, FIG. 4, may be employed to sample the blowdown, or to sample the feedwater to determine the concentration of the tracer. Monitor readouts for both feedwater and blowdown samples may be ratioed to determine cycles, FIG. 5, when the steady state is reached. Percent life holding time may be calculated. Examples will be given.

Figure 7:
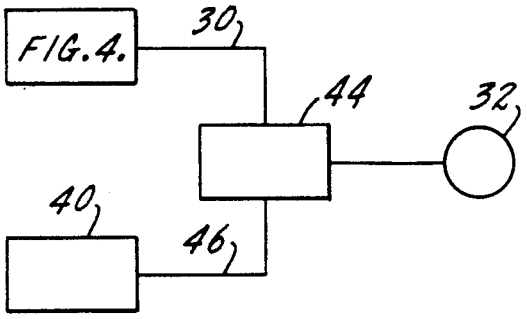
FIG. 7 is a diagram showing use of combined instruments in a feedback control system to maintain treating agent/metal ion feed ratio at a preset value.

Most boiler systems include analyzers to measure ppm metal ions which impart an undesired quality to the feedwater. Hardness is an example (or iron ions) but there are other metal ions which are undesired, all of which ($M^+$ herein) can be opposed by an appropriate treating agent. If the $M^+$ concentration is known, then the treating agent dosage shall be sufficient to combat $M^+$, neutralizing or removing $M^+$ altogether. The present invention can be employed in the role of thus purging the feedwater of $M^+$ and the arrangement is shown schematically in FIG. 7. The known analyzer for $M^+$ is designated 40, analyzing a sample of the feedwater and transmitting to a feedback computer 44 via line 46, an analog signal of the $M^+$ concentration. Combined with this known instrument is the continuous monitor instrument of FIG. 4 which will continuously analyze the feedwater for the tracer concentration and the monitor also transmits a concentration analog signal (via line 30 previously described) to the computer. The computer analyzes both signals and a resultant control signal is transmitted to the pump 32 when the computer determines the concentration of treating agent to combat $M^+$. Thus, the tracer monitor voltage signal in line 30, FIG. 4, is sent to the computer 44, FIG. 7, instead of being sent directly to the motor control for pump 32.

Figure 8:
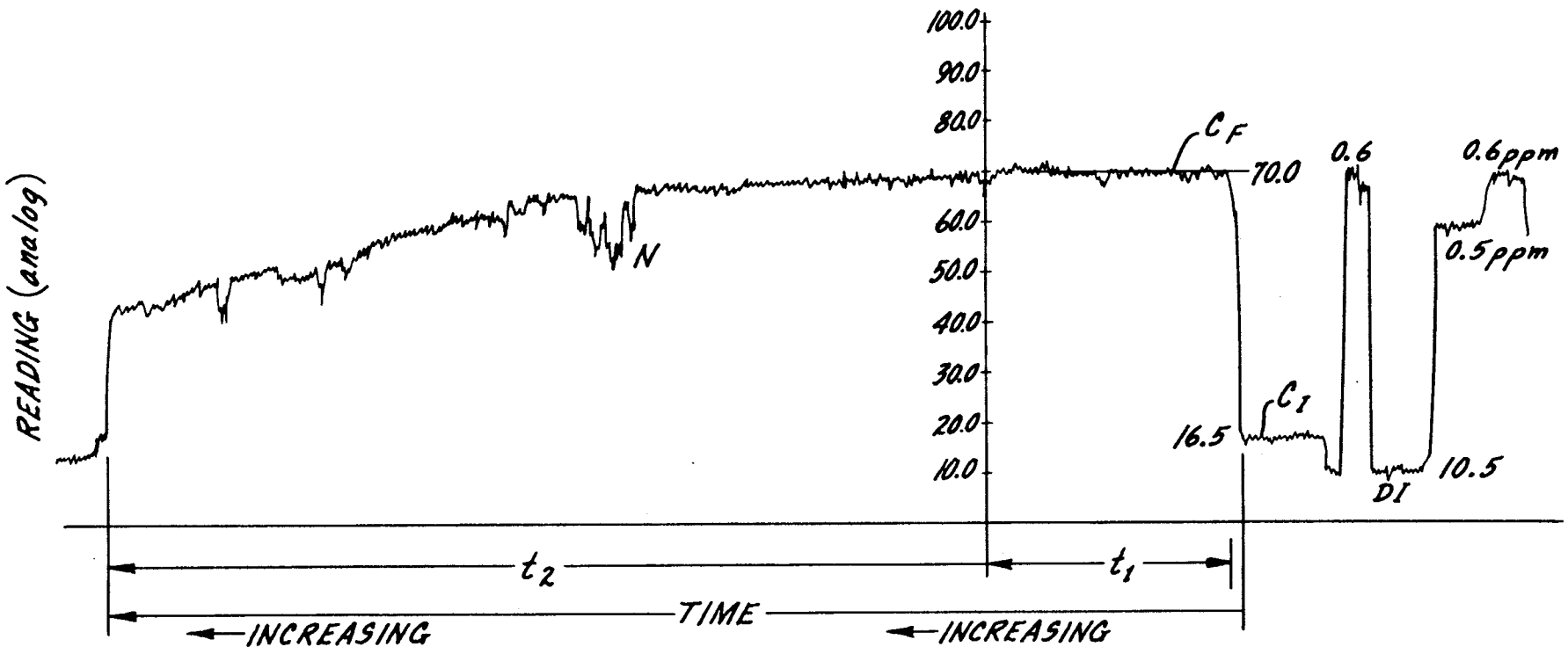
FIG. 8 depicts graphically continuous monitoring values.
Figure 6:
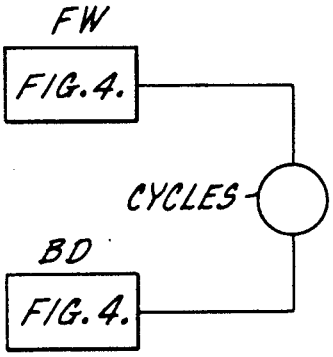
FIG. 6 is a diagram of combined instruments to measure cycles.

An actual performance record involving continuous monitoring and cycles is graphically depicted in FIG. 8. Two laboratory calibrations were checked using two standards (0.5 and 0.6 ppm 2-NSA tracer). The instrument was then calibrated first against distilled water (DI) at the process simulation site (read 10.5 analog) and then against a 0.6 ppm 2-NSA tracer standard After the calibration exercises, the instrument was then used to continuously monitor the feedwater of a boiler where the feedwater was dosed with 0.05 ppm NSA tracer, resulting in an analog reading of 16.5. After the boiler achieved steady state at analog 70, following introduction of 0.05 ppm tracer, the instrument was used to continuously monitor the blowdown represented by a continuous reading of about 70 over time period $t_1$. At the end of time $t_1$, feed of tracer was discontinued and thereafter the concentration of tracer in the boiler declined over time period $t_2$. Some noise N was encountered.

From a continuous register printout such as that shown in FIG. 8 (the data recorded in FIG. 2 were obtained by grab samples) it is a simple matter to determine or verify if the cycles are proper. Thus, the background or "control" condition (no tracer) is known (analog 10.5), the starting concentration of tracer in the feedwater is known (analog 16.5), and also the blowdown concentration at steady state, 70. Cycles is therefore $C_F/C_I=70-10.5/16.5-10.5=9.9$. In comparison, cycles for this example (FIG. 8) calculated mechanically ($M/_B$) was $9.8\pm0.1$ and by chloride was $9.4\pm0.3$.

The graphic depiction in FIG. 8, a replicate of an actual recording, shows how the percent life holding time may be calculated because the decline in tracer concentration during the time span $t_2$ is the mirror image of the rise in concentration of the component (tracer) in the boiler commencing with its initial introduction into the boiler. Indeed, FIG. 8 demonstrates the invention may be employed to monitor a species in a decreasing concentration (FIG. 8) as well as a species which is increasing, FIG. 2. Consequently it is clear how instantaneous concentrations $C_t$ may be taken from a continuous monitor record as FIG. 8 during the concentration time period for plotting a straight line (various values of $C_t/C_F$) as in FIG. 3 in order to determine the slope, $1/_K$ which, of course, gives the reciprocal of the boiler constant K and hence K is a matter of division. A slope as in FIG. 3, plotted from the data of FIG. 2, is the same when viewed as a mirrow image; only the sign (+,−) is different. Thus it will be seen that a continuous recording of the tracer concentration, as a stable component, permits accurate determination of enough $C_t/C_F$ points during the concentration period to plot the straight line of various values of $\ln(1-C_t/C_F)$ in equation (2) or to determine the slope (e.g. FIG. 3) which gives the inverse or reciprocal of the boiler constant K. Knowing K and knowing $C_F$, unknowns in the holding time equation (3) can be calculated.

Figure 9:
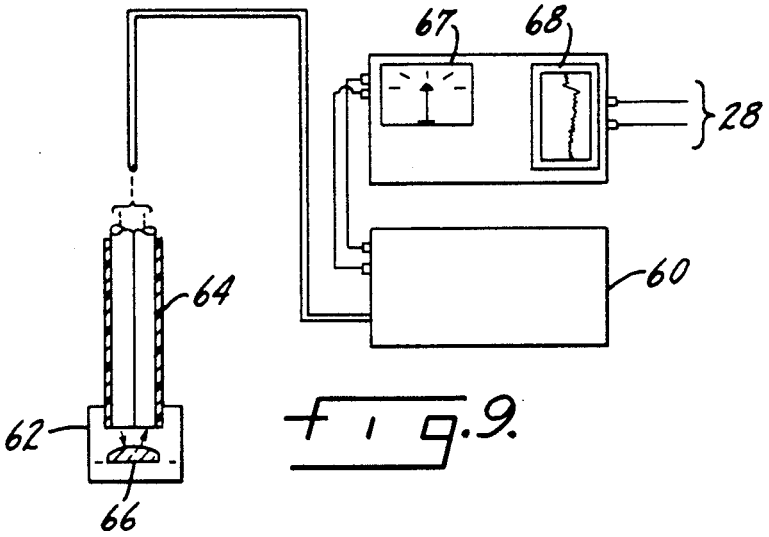
FIG. 9 is a schematic diagram for colorimetry monitoring.

Colorimetry or spectrophotometry may be employed for an inert tracer such as a dye, in which event the voltage concentration analog is based on absorbance values rather than fluorescent emissivity. The schematic arrangement is shown in FIG. 9, using a Brinkman PC-801 probe colorimeter (540 nm filter). The sample solution is admitted to a flow cell 62 in which a fiber optic dual) probe 64 is immersed. One fiber optic cable shines incident light through the sample on to a mirror 66 inside the cell and reflected light is transmitted back through the sample liquid into a fiber optic cable and then to the colorimetric analyzer unit by the other cable as shown by arrows. The colorimeter 60 has a transducer which develops an electrical analog signal of the reflected light characteristic of the tracer concentration. The voltage emitted by the transducer activates a dial indicator 67 and a continuous line recorder printout unit 68 A set point voltage monitor (not shown, but as in the foregoing embodiment) will constantly sense (monitor) the voltage analog generated by the colorimeter accordingly to control the pump which supplies the treating agent and proportioned tracer.

An ion selective electrode may be employed to determine the concentration of an inert tracer ion ($K^+$ is a good example) in terms of the relationship between the electrical signal developed by the electrode and the concentration of tracer. By calibration (potential or current vs. concentration) the ionic concentration at the sample electrode can be indexed to a reference (standard) electrode which is insensitive to the inert tracer ion. To provide continuous monitoring of the tracer ion, the electrodes may be dipped directly into a flowing stream of the sample, collectively constituting a flow cell, or the sample could be passed through an external flow cell into which the ion-selective and reference electrodes have been inserted.

Figure 10:
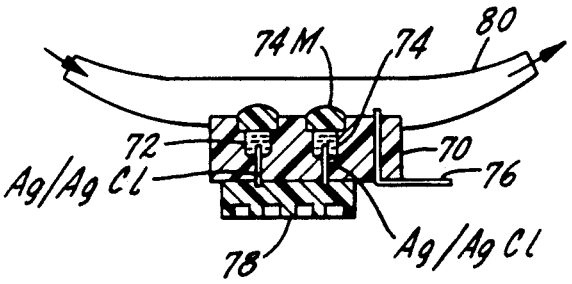
FIGS. 10 and 11 illustrate the use of an ion selective electrode as a monitor transducer.

An example of a flow cell incorporating an ion selective electrode system is shown in FIG. 10, comprising a PVC (polyvinyl chloride) sensor base or module 70 containing the reference and sample electrodes (cells) respectively denoted 72 and 74, each including a silver/silver chloride electrode wire, and a grounding wire 76. These electrodes constitute an electrochemical cell across which a potential develops proportional to the logarithm of the activity of the selected ion.

An eight pin DIP socket 78 will be wired to a standard dual FET ("field effect transistor") op amp device. The sample is conducted across the electrodes by a flexible tube 80; the tracer ions penetrate only the sample (ion selective) electrode cell 74.

Figure 11:
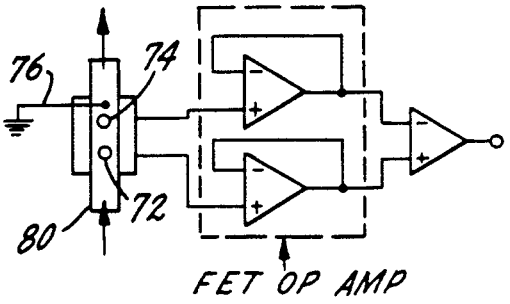

The FET op amp device (a dual MOSFET op amp) is thus connected to the flow cell shown in FIG. 10 to perform the impedance transformation, whereby the potential difference between the reference and sample electrodes may be obtained, using an amplifier, FIG. 11.

Here, FIG. 10, the transducer is in effect the ionophore membrane 74M of the sample electrode allowing the selected ion activity (concentration) to be transformed to a weak voltage which when amplified can be monitored between setpoints as in the foregoing embodiments.

Finally, another advantage to the invention relates to the concept of carryover, and specifically to the difference between two species of carryover, namely, selective and mechanical. Some chemical species can be vaporized inside the boiler and will selectively carry over into the steam. This is not wanted, of course, since some ions will cause deposits or corrosion; sodium and silicates are examples. The inert tracers featured in the present invention will not carry over selectively and hence their value in quantifications under and in accordance with the present invention.

Mechanical carryover characterizes inefficient boiler performance in that water droplets per se become captured in the steam; that is, water droplets are entrained in the body of steam and such droplets will themselves carry the inert tracer which enables mechanical carryover to be detected and corrected. Thus, the feedwater may be dosed with an inert tracer. A sample of condensed steam may then be removed from time to time and monitored for any tracer content, in the ways and means already described for monitoring the tracer content in the feedwater or blowdown. The steam may thus be monitored for mechanical carryover simultaneously with either of the other modes of monitoring. Clearly, if the tracer is carried over mechanically there is a possibility of dissolved and suspended solids being carried over in like manner.

Hence while we have described and illustrated a preferred embodiment of the invention, it is to be understood this is capable of variations and modification, adopting equivalents within the purview of the appended claims.

We claim:

1. A method of determining blowdown:feedwater concentration cycles in a boiler water system where steam is generated in a boiler from fresh feedwater fed thereto, and wherein the concentration of impurities in the boiler water is reduced by withdrawing boiler water as blowdown while admitting additional feedwater as makeup, said concentration cycles being the value of the concentration ($C_F$) of a component in the blowdown at steady state divided by the concentration ($C_I$) of that component in the feedwater, said component likewise having no appreciable carryover into the steam, said method comprising the steps of:

employing as the component an inert tracer added to the feedwater in a known concentration ($C_I$), next, sensing a characteristic of the tracer in the blowdown at steady state equivalent to its blowdown concentration ($C_F$), converting the sensed characteristic to ($C_F$), and then recording the concentration cycles value of $C_F/C_I$ for the boiler, said characteristic being one selected from the group consisting of emissivity, absorbance and ion activity.

2. Method according to claim 1 in which a treating agent is added to the feedwater in a predetermined concentration to oppose the tendency of impurities to settle as solids on the boiler surfaces, in which the calculated cycles value of $C_F/C_I$ is compared to a cycles value deemed standard for operation of the boiler, and in which the blowdown rate or dosage of treating agent is changed to establish the standard operating cycles value if the calculated value is not standard.

3. Method according to claim 1 in which the tracer is fluorescent, in which the sensed characteristic of the tracer is emissivity, and including the steps of: converting the sensed emissivity characteristic of the tracer to a voltage analog, and continuously monitoring and recording said analog.

4. Method according to claim 2 including the steps of: converting the sensed characteristic of the tracer to a voltage analog, and continuously monitoring and recording said analog.

5. In a boiler system where a boiler charged with feedwater generates steam therefrom, wherein metal ions detrimental to boiler efficiency are present in the feedwater as impurities and wherein a treating agent in a predetermined concentration is added to the feedwater having the role of removing or neutralizing said impurities, a method of correcting the dosage of treating agent if there is a variance from the amount deemed optimum for the role, including the steps of: adding to the feedwater an inert tracer in a concentration proportioned to the treating agent concentration, measuring a characteristic of the tracer equivalent to its blowdown concentration in the feedwater, said characteristic being one selected from the group consisting of emissivity, absorbance and ion activity, measuring the concentration of metal ions in the feedwater, comparing the two measurements to determine if the concentration of treating agent varies from optimum, and changing the dosage of treating agent if said determination shows a variance.

6. A method according to claim 5 including the steps of converting the sensed characteristic to a voltage analog, and using the voltage analog for comparison to the measurement of metal ion concentration in the feedwater.

7. Method according to claim 5 in which a sample of steam condensate is taken and analyzed for tracer presence.

8. Method according to claim 6 in which a sample of steam condensate is taken and analyzed for tracer presence.

9. In a boiler system where a boiler charged with feedwater of mass M, which may be an unknown mass, generates steam therefrom at a particular temperature, wherein the concentration of impurities in the boiler water is reduced by withdrawing boiler water as blowdown at a particular rate B (mass per unit of time) which may also be an unknown, a method of determining the boiler constant $K=M/_B$ including the steps of: adding to the feedwater an inert tracer in a predetermined concentration $C_I$ which eventually reaches a final state of steady concentration $C_F$ in the boiler; determining at different times the concentration $C_t$ of the tracer in the blowdown and determining $C_F$ of the tracer at steady state; and plotting the straight line slope of $\ln(1-C_t/C_F)$ versus time which slope gives the value of the reciprocal of K.

10. Method according to claim 9 including the step of continuously sensing in the blowdown a characteristic of the tracer equivalent to its blowdown concentration $C_t$; said characteristic being one selected from the group consisting of emissivity, absorbance and ion activity; continuously converting said equivalent to an analog and recording the concentration analog as a function of time during the time period required for the tracer to reach its steady-state concentration $C_F$ in the boiler; determining $C_F$ from said recording, calculating the values of $C_t/C_F$ for different times according to said recording, and determining K therefrom according to claim 9.

11. A method of determining it there is mechanical carryover of water droplets into a body of steam generated in a water boiler charged with feedwater, comprising the steps of adding an inert tracer to the feedwater, taking a sample of steam condensate and analyzing the sample for tracer presence.

* * * * *

UNITED STATES PATENT AND TRADEMARK OFFICE

CERTIFICATE OF CORRECTION

PATENT NO. : 5,041,386

DATED : Aug. 20, 1991

INVENTOR(S) : Claudia C. Pierce, Roger W. Fowee, John E. Hoots

It is certified that error appears in the above—identified patent and that said Letters Patent is hereby corrected as shown below:

Column 4, line 10, after "in" second occurrence, add --lbs/hr).--

Signed and Sealed this

Sixth Day of April, 1993

*Attest:*

STEPHEN G. KUNIN

*Attesting Officer*

*Acting Commissioner of Patents and Trademarks*